US008384276B2

(12) United States Patent
Hsieh et al.

(10) Patent No.: US 8,384,276 B2
(45) Date of Patent: Feb. 26, 2013

(54) LED LAMP STRUCTURE

(75) Inventors: Min-Tsun Hsieh, Hsinchu (TW); Wen-Liang Tseng, Hsinchu (TW); Lung-Hsin Chen, Hsinchu (TW); Chih-Yung Lin, Hsinchu (TW); Ching-Lien Yeh, Hsinchu (TW)

(73) Assignee: Advanced Optoelectronic Technology, Inc., Hsinchu Hsien (TW)

( * ) Notice: Subject to any disclaimer, the term of this patent is extended or adjusted under 35 U.S.C. 154(b) by 74 days.

(21) Appl. No.: 13/167,704

(22) Filed: Jun. 24, 2011

(65) Prior Publication Data

US 2012/0074827 A1 Mar. 29, 2012

(30) Foreign Application Priority Data

Sep. 23, 2010 (CN) ..... 2010 1 0289256

(51) Int. Cl.
*H01J 1/02* (2006.01)

(52) U.S. Cl. ..... 313/46; 362/294; 362/249.02; 313/11

(58) Field of Classification Search ..... 313/46, 313/11–12; 362/294, 362, 373, 543–549, 362/555, 800, 249.01–249.03
See application file for complete search history.

(56) References Cited

FOREIGN PATENT DOCUMENTS

| | | |
|---|---|---|
| CN | 101398159 A | 4/2009 |
| TW | M334272 | 6/2008 |

*Primary Examiner* — Donald Raleigh
(74) *Attorney, Agent, or Firm* — Altis Law Group, Inc.

(57) ABSTRACT

An LED lamp structure includes a heat sink and a base. The heat sink includes a first receiving cavity, a second receiving cavity opposite to the first receiving cavity and a partition. A light board having LED modules is mounted on the partition. The partition defines two first threaded through holes therein. The base has two positioning protrusions engaging in two positioning grooves of the heat sink. Thus, second screw holes of two screw pillars of the base are aligned at the first screw holes of the partition of the heat sink. Screws are used to threadedly engage in the first screw holes, the second screw holes and third screw holes in the light board to thereby assemble the heat sink, the base and the light board together.

7 Claims, 7 Drawing Sheets

LED LAMP STRUCTURE

BACKGROUND

1. Technical Field

The disclosure relates to light emitting diodes, and particularly to a lamp structure incorporating light emitting diodes.

2. Description of the Related Art

Light emitting diodes' (LEDs) many advantages, such as high luminosity, low operational voltage, low power consumption, compatibility with integrated circuits, easy driving, long term reliability, and environmental friendliness have promoted their wide use as a light source. Now, light emitting diodes are commonly applied in environmental lighting.

A base and a heat sink of a commonly used LED lamp structure respectively have screw holes. The base is fixed on the heat sink with the screws passing through the corresponding screw holes. However, that increases the manufacturing cost and assembly time and decreases the yield of the LED lamp structure.

Therefore, it is desirable to provide an LED lamp structure which can overcome the described limitations.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the present LED lamp structure. Moreover, in the drawings, like reference numerals designate corresponding parts throughout the views.

DETAILED DESCRIPTION

Embodiments of an LED lamp structure as disclosed are described in detail here with reference to the drawings.

Figure 1:
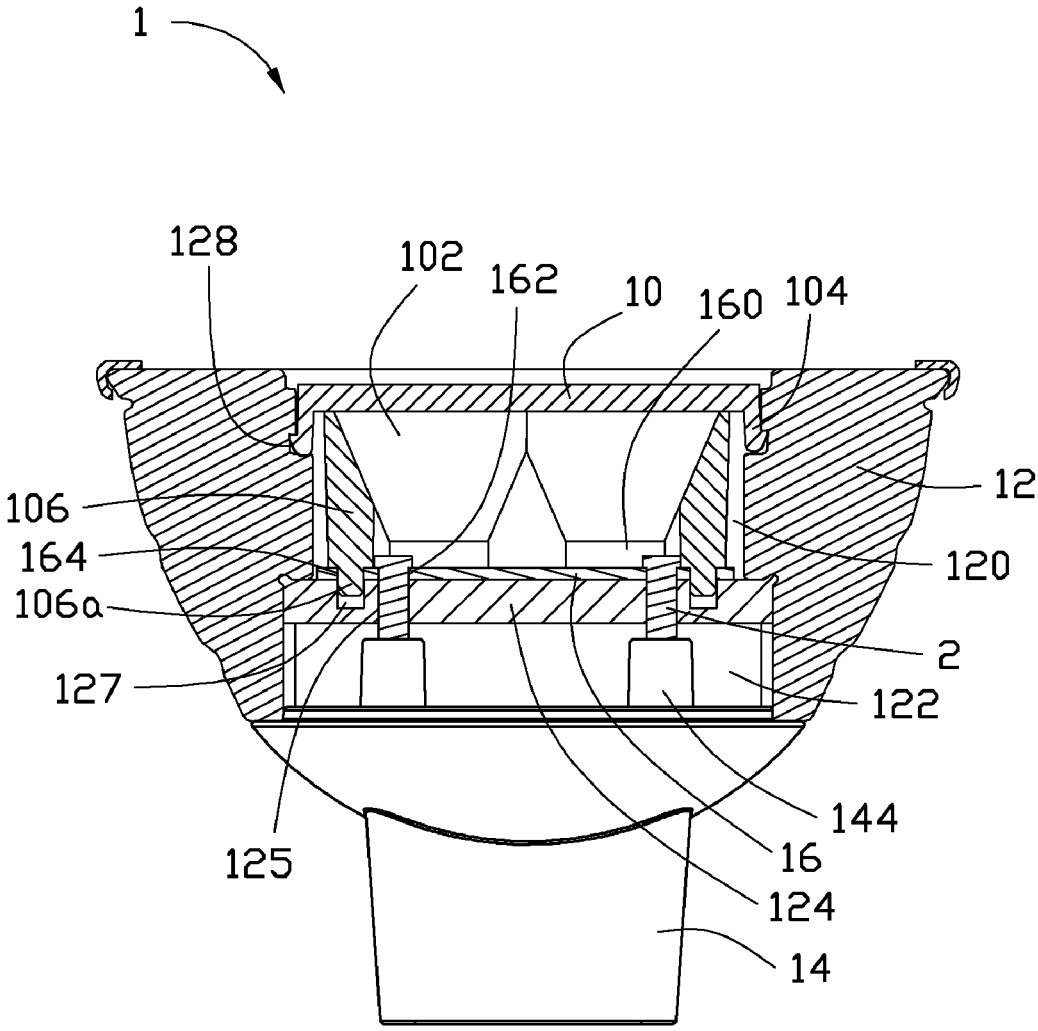
FIG. 1 is a side cross-sectional view of an LED lamp structure in accordance with a first embodiment.

Referring to FIG. 1, an LED lamp structure 1 includes a cover 10, a heat sink 12, a base 14, and a light board 16.

Figure 2:
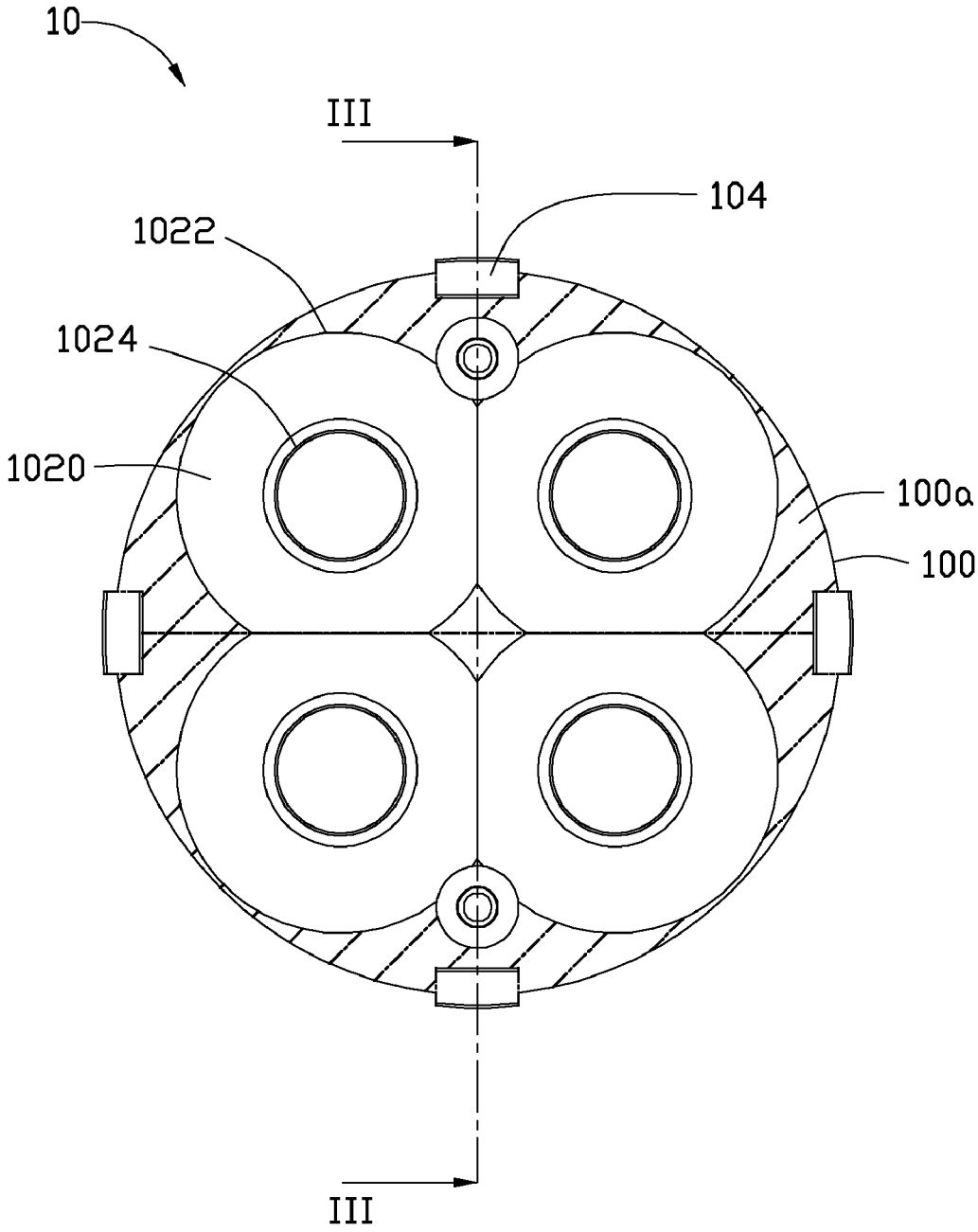
FIG. 2 is a top view of a cover of the LED lamp structure of FIG. 1.
Figure 3:
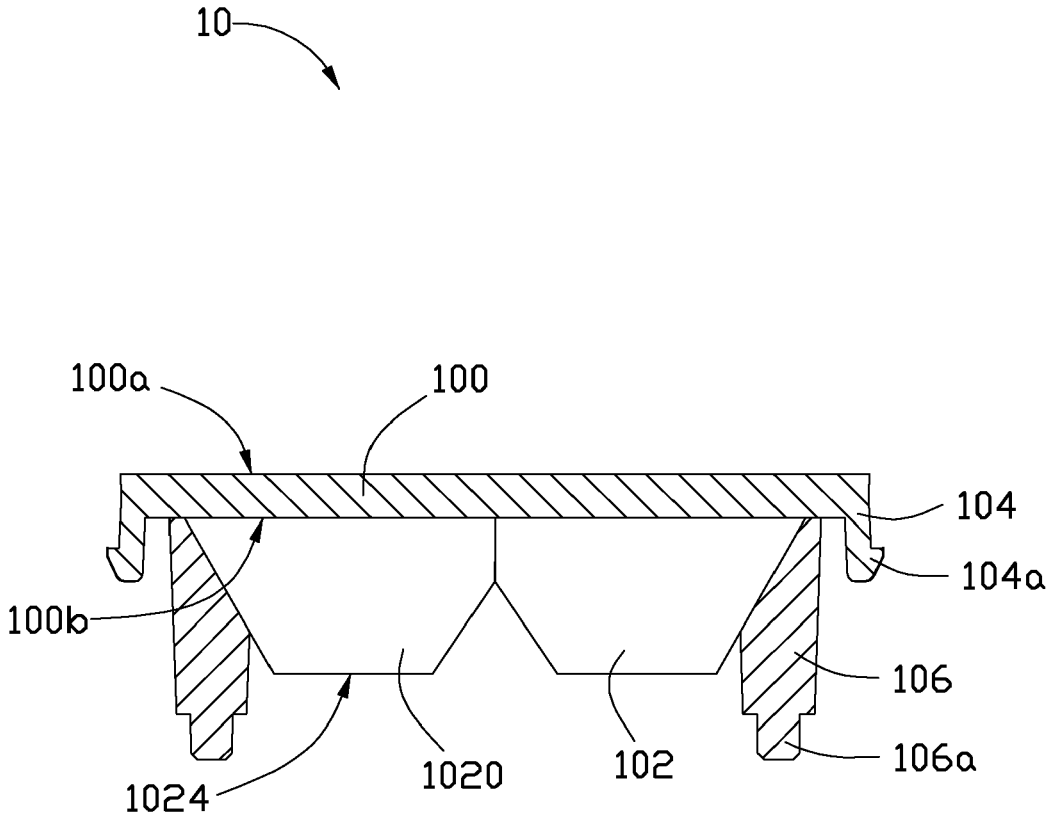
FIG. 3 is a cross-sectional view taken along line III-III of the cover of the LED lamp structure of FIG. 2.

Referring to FIGS. 2-3, the cover 10 includes a substrate 100, a plurality of reflection covers 102, a plurality of tenons 104, and two positioning pillars 106. The substrate 100 includes a top surface 100*a* and a bottom surface 100*b*. The reflection cover 102 includes a sidewall 1020, a first opening 1022, and a second opening 1024. The first opening 1022 passes through the top surface 100*a* of the substrate 100, and the sidewall 1020 is extended inwards from the bottom surface 100*b* of the substrate 100 along a downward direction. An internal diameter of the sidewall 1020 gradually decreases from the bottom surface 100*b* of the substrate 100 along a downward direction, and forms a second opening 1024 at a bottom end of the side wall 1020. In this embodiment, the number of the reflection covers 1020 is four and are arranged in array at a center portion of the substrate 100. The tenon 104 is at one edge of the substrate 100 and extends perpendicularly downwards from the edge of the bottom surface 100*b* of the substrate 100. A hook 104*a* toward an outside of the substrate 100 is formed at a bottom end of the tenon 104 away the bottom surface 100*b* of the substrate 100. In this embodiment, the number of the tenons 104 is four and are arrayed mutually each with the same interior at the edge of the substrate 100. The positioning pillar 106 is extended perpendicularly downwardly from the bottom surface 100*b* of the substrate 100. The positioning protrusion 106*a* having a radius, which is less than a radius of the position pillar 106 is formed at a bottom end of the positioning pillar 106. In this embodiment, the position pillars 106 are two and are respectively formed on the bottom surface 100*b* of the substrate 100 between opposite two of the tenons 104 and the reflection cover 102.

Figure 4:
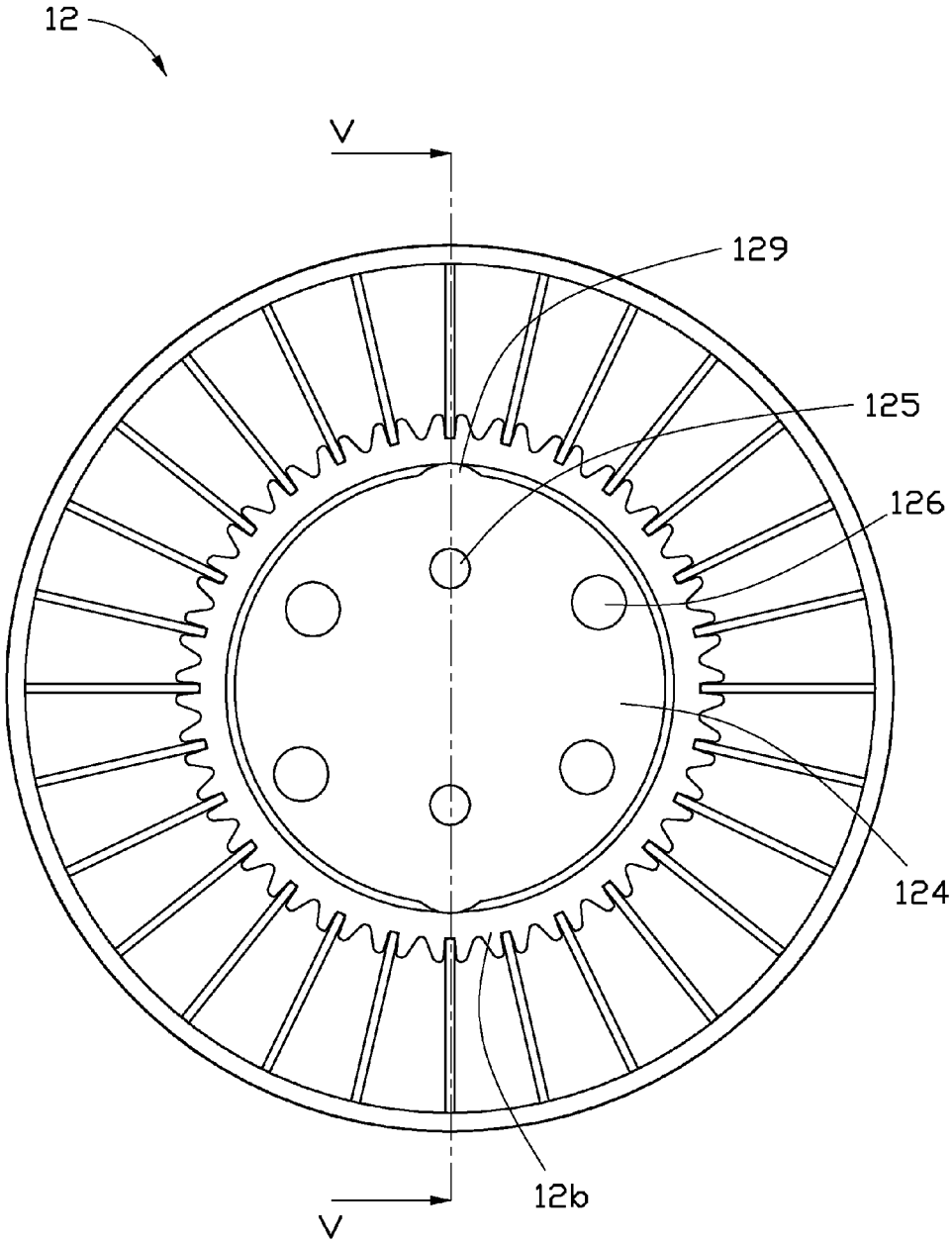
FIG. 4 is a bottom view of a heat sink of the LED lamp structure of FIG. 1.
Figure 5:
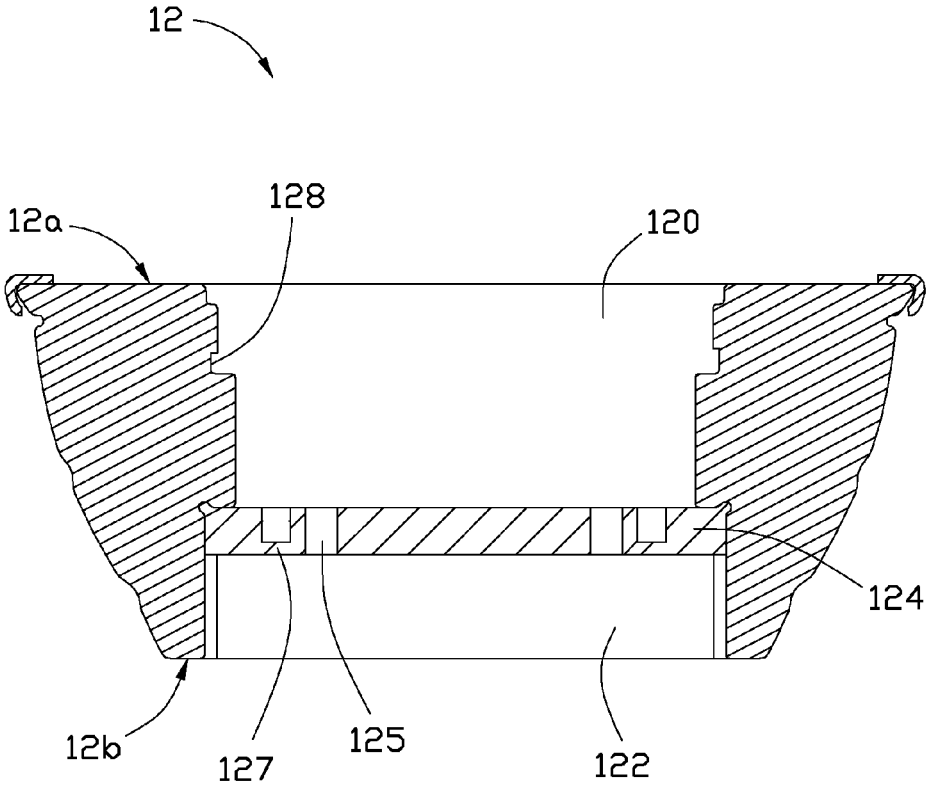
FIG. 5 is a cross-sectional view taken along line V-V of the heat sink of the LED lamp structure of FIG. 4.

Referring to FIGS. 4 and 5, the heat sink 12 includes a first surface 12*a* for emitting light and a second surface 12*b* opposite to the first surface 12*a*. A first receiving cavity 120 is defined on the first surface 12*a*. A second receiving cavity 122 is defined on the second surface 12*b*.

A partition 124 is between the first receiving cavity 120 and the second receiving cavity 122. Two first threaded through holes 125 used for fixing the base 14, four through holes 126 used for connecting electric wires, and two positioning blind holes 127 used for aligning the cover 10 are arranged on the partition 124.

The first receiving cavity 120 is used for assembling the cover 10. A mortise 128 arranged on a first inside wall of the receiving cavity 120 is corresponding to the tenon 104 of the cover 10. Two positioning grooves 129 are arranged in an inside sidewall of the second receiving cavity 122 along an axial direction of the heat sink 12. The positioning grooves 129 are diametrically opposite to each other. The two first threaded through holes 125 are positioned between the positioning grooves 129 and aligned therewith.

Figure 6:
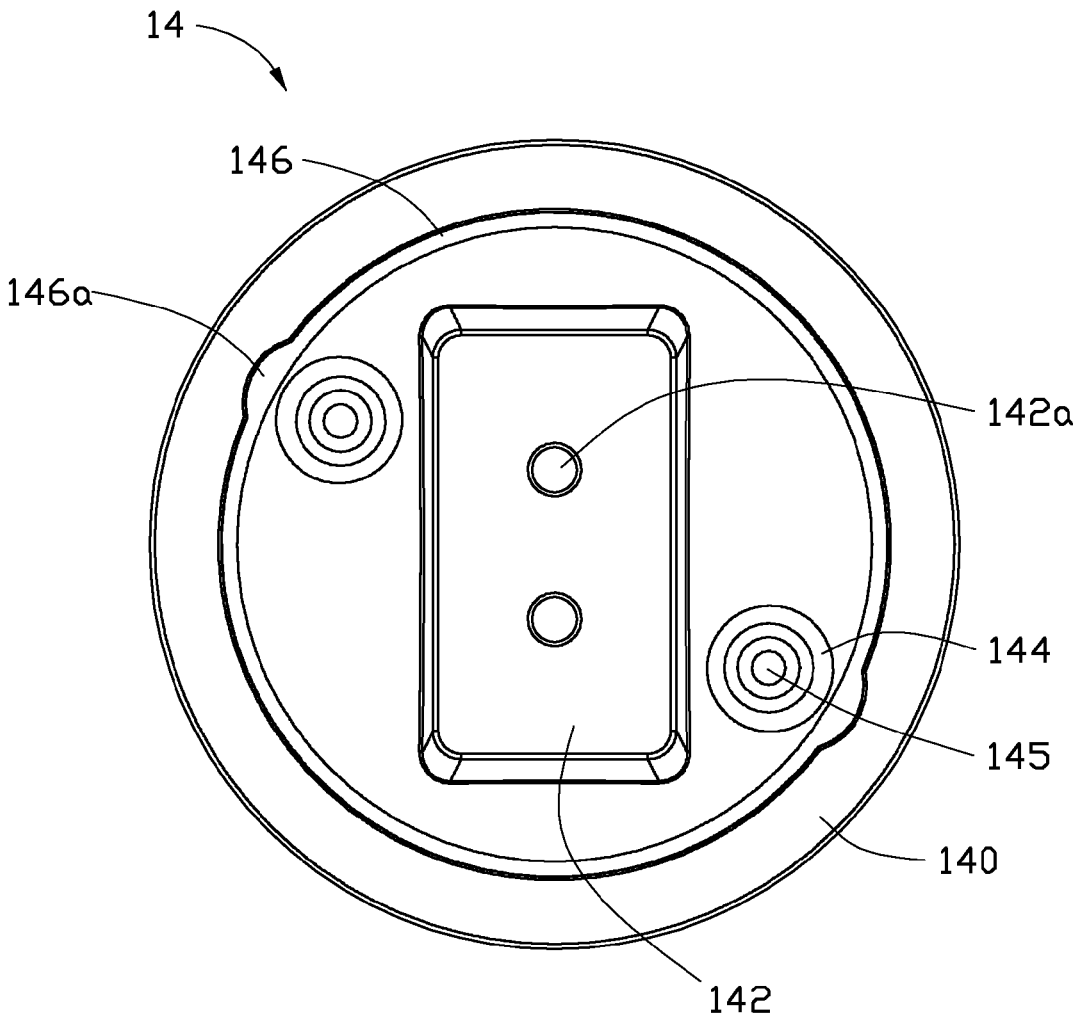
FIG. 6 is a top view of a base of the LED lamp structure of FIG. 1.
Figure 7:
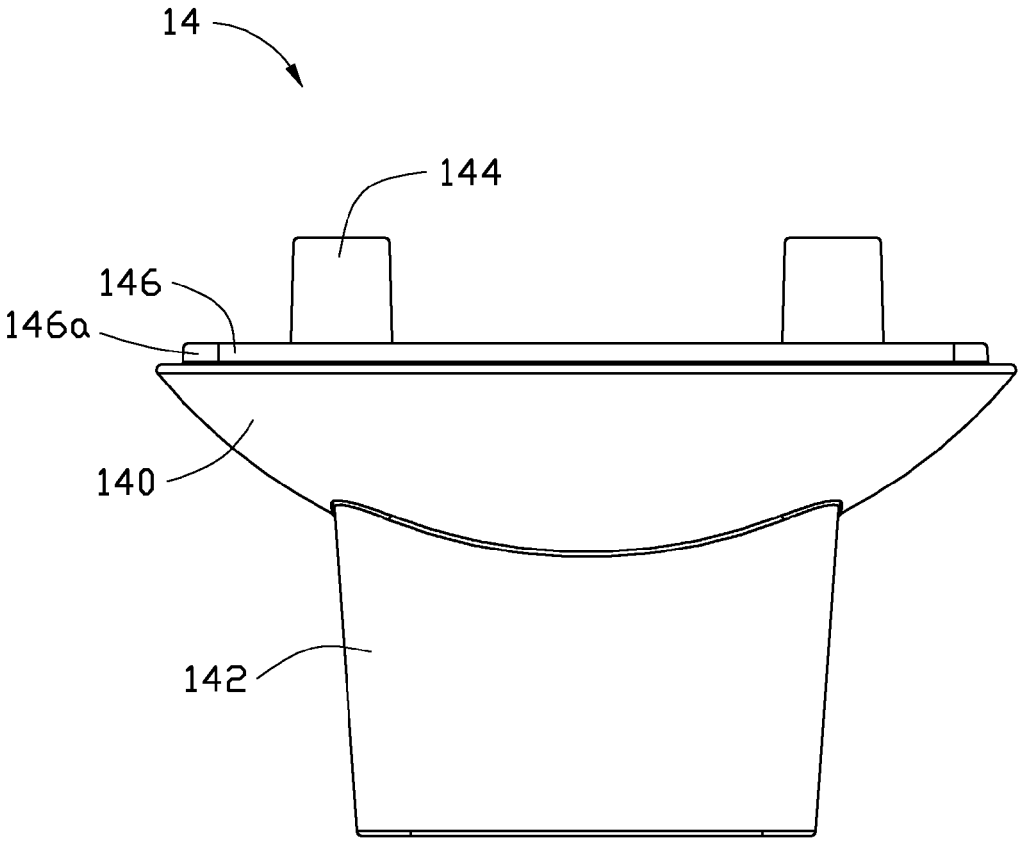
FIG. 7 is a side view of the base of the LED lamp structure of FIG. 1.

Referring to FIGS. 6 and 7, the base 14 includes a plate 140, a hollow connection handle 142 connecting to a bottom of the plate 140, two screw pillars 144, and a flange 146. The plate 140 is semispherical with a flat top face, and the screw pillars 144 are extended upwardly from the flat top face of the plate 140. An extending direction of the screw pillars 144 is opposite to a direction of the connection handle 142 which is extended downwardly from an arced bottom of the plate 140. The screw pillars 144 and the connection handle 142 are respectively arranged at the two opposite sides of the plate 140.

A second screw hole 145 corresponding to one of the first threaded through holes 125 of the heat sink 12 is formed at a bottom end of each of the screw pillars 114. The flange 146 is extended upwards from the top face of the plate 140, and surrounds the screw pillars 144 along an edge of the plate 140. Two positioning protrusions 146*a* are formed by the flange 146 corresponding to the screw pillars 144. Two connecting through holes 142*a* are defined in the connection handle 142 for extension of electrical wires therethrough.

Referring to FIGS. 1 to 7, four light emitting diode modules 160, two third screw holes 162 of the light board 16, two positioning through holes 164 corresponding to the positioning pillars 106 of the cover 10 are arranged on the light board 16. The quantity of the light emitting diode modules 160 is equal to that of the reflection covers 102 of the cover 10. In this embodiment, the quantities of the light emitting diode modules 160 are four and arranged in array.

The light board 16 is arranged on the partition 124 by the first receiving cavity 120. The third screw holes 162 of the light board 16 are aligned with the first screw holes 125 of the partition 124. The positioning through holes 164 of the light board 16 are aligned mutually at the positioning blind holes 127 of the partition 124. The screw pillars 144 of the base 14 extend into the second receiving cavity 122.

The wires of the light emitting diode modules 160 are connected to the external power via the through holes 126 and the connecting through holes 142*a* of the connection handle 142. The positioning protrusions 146*a* of the flange 146 of the base 14 are embedded into the positioning grooves 129 of an inside wall of the second receiving cavity 122. Thus, the second screw holes 145 of the screw pillars 144 are aligned at the first screw holes 125 of the partition 124 and the third screw holes 162 of the light board 16. The light board 16 and the base 14 are fixed on the partition 124 of the heat sink 12 with screws 2. Finally, the cover 10 is arranged inside the first receiving cavity 120. The positioning protrusions 106*a* of the positioning pillars 106 of the cover 10 pass through the corresponding positioning through holes 164 of the light board 16, and then are embedded into the positioning blind holes 127 of the partition 124. Thus, the light emitting diode modules 160 of the light board 16 are embedded into the second opening 1024 and are surrounded by the reflection covers 102 of the cover 10, respectively. The tenons 104 of the cover 10 are respectively inserted into the mortises 128 in the first inside wall of the first receiving cavity 120. The cover 10 is fixed on the heat sink 12.

The LED lamp structure 1 consisting of the base 14 and the heat sink 12 respectively has the positioning protrusions 146*a* and the positioning grooves 129. Thus, the second screw holes 145 of the screw pillars 144 of the base 14 are aligned along with the first screw holes 125 of the partition 124 of the heat sink 12 with the positioning protrusions 146*a* engaging in the positioning grooves 129.

While the disclosure has been described by way of example and in terms of exemplary embodiment, it is to be understood that the disclosure is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An LED (light-emitting diode) lamp structure, comprising: a heat sink, and a base for connecting to an external power, the heat sink including a first receiving cavity and a second receiving cavity opposite to the first receiving cavity, and a partition between the first receiving cavity and the second receiving cavity; wherein an inside wall of the second receiving cavity has two positioning grooves corresponding to first screw holes defined through the partition, the base includes screw pillars each having a second screw hole, a flange surrounded the screw pillars, an outside of the flange corresponding to the screw pillars having position protrusions, the flange fixed to the inside wall of an open end of the second receiving cavity by the positioning protrusions engaging in the positioning grooves, the screw pillars being received into the second receiving cavity, the second screw holes being aligned with the first screw holes, screws extending through the first screw holes and the second screw holes to cause the screw pillars to be fixed at the partition, a light board having light emitting diode modules, and third screw holes corresponding to the first screw holes being arranged in the light board, the light board being located on the partition with the third screw holes aligning with the first and second screw holes, the light board, the partition and screw pillars are fixed together by the screws extending in the third screw holes.

2. The lamp structure of claim 1 further including a cover, wherein the cover includes a substrate arranged on an opening of the first receiving cavity, positioning pillars on the substrate, and the substrate is located over the partition by the positioning pillars extending downwardly through the light board into the partition.

3. The lamp structure of claim 2, wherein the substrate includes a top surface and a bottom surface opposite to the bottom surface, the positioning pillars being extended perpendicularly downwardly from the bottom surface of the substrate, positioning studs being formed at bottom ends of the positioning pillars, two positioning blind holes corresponding to two positioning through holes in the light board being arranged on the partition, the cover being arranged inside the first receiving cavity with the positioning studs of the positioning pillars of the cover passing through the positioning through holes of the light board, and then being embedded into the positioning blind holes of the partition.

4. The lamp structure of claim 3, wherein the cover further includes at least a reflection cover, the at least a reflection cover includes a sidewall, a first opening, and a second opening, the first opening passes through the top surface of the substrate, the sidewall is extended inwards from the bottom surface of the substrate along a downward direction, an internal diameter of the sidewall gradually decreases from the bottom surface of the substrate along the downward direction, and forms a second opening at a bottom end of the side wall.

5. The lamp structure of claim 3, wherein the cover further includes a plurality of tenons arranged at one edge of the substrate, the tenons are extended perpendicularly downwards from the bottom surface of the substrate, a hook toward an outside of the substrate is formed at one end of each of the tenons away the bottom surface of the substrate, a mortise arranged in an inside wall of the first receiving cavity is corresponding to one of the tenons of the cover, the cover is arranged on the heat sink, and the tenons of the cover are respectively inserted into the mortises in the inside wall of the first receiving cavity.

6. The lamp structure of claim 1, wherein the base further includes a plate and a connection handle arranged on a bottom side of the plate, the screw pillars are extended upwardly from a top side of the plate, and the flange along the edge of plate is extended upwardly from the top side of the plate.

7. The lamp structure of claim 6, wherein connecting through holes are defined in the connection handle, the partition of the heat sink has through holes, and the connecting through holes and the through holes are communicated with each other, adapted for wires of the light emitting diode modules to extend therethrough to connect with an external power.

* * * * *